US005423793A

United States Patent [19]

Isono et al.

[11] Patent Number: 5,423,793

[45] Date of Patent: Jun. 13, 1995

[54] STOPPER DEVICE FOR CONTAINER AND MIXING APPARATUS USING THE SAME

[75] Inventors: Keinosuke Isono, Kawaguchi; Tatsuo Suzuki, Machida, both of Japan

[73] Assignee: Material Engineering Technology Lab., Inc., Tokyo, Japan

[21] Appl. No.: 156,985

[22] Filed: Nov. 23, 1993

Related U.S. Application Data

[63] Continuation of Ser. No. 848,594, Mar. 9, 1992.

[30] Foreign Application Priority Data

Mar. 8, 1991 [JP] Japan ..... 3-68886
Mar. 8, 1991 [JP] Japan ..... 3-68887

[51] Int. Cl.[6] ..... A61J 1/00

[52] U.S. Cl. ..... 604/410; 604/411; 604/408; 604/403

[58] Field of Search ..... 604/403, 408, 411, 412, 604/413, 414, 415, 410

[56] References Cited

U.S. PATENT DOCUMENTS 3,757,981 9/1973 Harris, Sr. et al. ..... 604/414 X
3,917,063 11/1975 Chibret et al. .
4,187,893 2/1980 Bujan ..... 604/415 X
4,193,402 3/1980 Rumpler ..... 604/415
4,857,068 8/1989 Kahn ..... 604/411 X
5,004,113 4/1991 Nogawa ..... 604/403 X
5,137,528 8/1992 Crose ..... 604/415

FOREIGN PATENT DOCUMENTS 0285424 10/1988 European Pat. Off. .
61-501129 6/1986 Japan .
62-11626 3/1987 Japan .
2-1277 1/1990 Japan .

*Primary Examiner*—Sam Rimell
*Attorney, Agent, or Firm*—Millen, White, Zelano, & Branigan

[57] ABSTRACT

The present invention provides a stopper device comprising a stopper-support structure having a passage inside and a stopper accommodated in the-passage so as to block the passage but movably in the passage, as well as an apparatus containing the stopper device, used for mixing of two components. The stopper device can be penetrated with a connecting device with no edge and therefore generates no debris during penetration and reliably prevents leakage of container contents.

14 Claims, 13 Drawing Sheets

STOPPER DEVICE FOR CONTAINER AND MIXING APPARATUS USING THE SAME

This application is a continuation of application Ser. No. 07/848,594, filed Mar. 9, 1992.

BACKGROUND OF THE INVENTION

1. Field of the Invention

The present invention relates to a stopper device for a container in which a passage for access to the interior of container can be easily formed in a state in which the stopper device is fitted to a container. More particularly, the present invention relates to a stopper device for container used, for example, in medical treatment, which enables easy formation of a passage therein With a connecting device having no edge at the front end and which requires, for passage formation, no hollow tube having an edge at the front end (e.g. spike needle, injection needle).

The present invention further relates to a mixing apparatus using the above stopper device, for example, a container for transfusion suitably used in instillation.

2. Description of the Prior Art

There are various types of stopper devices for container. A rubber stopper is often used when it is required to take out contents from a container or to inject a certain material into the container, for example, when a drug solution for medical treatment is prepared by mixing or is transferred, because the rubber stopper can provide a simple and effective means for shielding the contents from the air. In this case, the perforation of the rubber stopper has been conducted by stabbing the rubber stopper with a hollow connecting device having an edge at one end such as spike needle, injection needle or the like. In the field of medical treatment, in particular, a rubber stopper is widely used as a stopper device for containers. The rubber stopper is used also as a stopper device for a container for transfusion. Ordinarily, the spike needle of a transfusion device is inserted into the rubber stopper fitted to a container for transfusion and the drug solution contained in the container is administered to a patient through the transfusion device. Since this spike needle is a hollow needle having an edge at one end, part of the rubber stopper is cut off by the edge and mixed with the drug solution in the container; this has invited the generation of a foreign matter in the drug solution, i.e. the generation of a foreign matter by coring. A thick spike needle is used when transfusion must be made at a high rate; in such a case, part of the rubber stopper is easily cut off and the generation of a foreign matter is easily invited.

A powdery drug such as antibiotic or anticancer drug, or a freeze-dried drug is contained in a container such as vial or the like and then sealed with a rubber stopper. Such a powdery drug or a freeze-dried drug is dissolved in a dissolving agent before being administered to a patient. In this case, the container containing the above drug and the container containing the dissolving agent are connected by using a connecting device such as double-ended needle, connecting tube having a spike needle or the like at one end, and then the dissolving agent is transferred into the container containing the drug to dissolve the drug. The connection of the two containers with the double-ended-needle or the connecting tube is conducted by stabbing the respective rubber stoppers of the two containers with the double-ended needle or the spike needle of the connecting tube;

as a result, it has invited the introduction of foreign matter from coring as well. In order to-conduct the transfer of the dissolving agent swiftly, it is necessary to use a double-ended needle or a spike needle, each having a large inside diameter. The use of such a needle having a large inside diameter, however, requires a large force for puncturing and makes the connection of the two containers difficult and further invites the generation of debris from coring and possibly the blocking of the through-hole of the double-ended needle or spike needle with part of the rubber chips generated.

The rubber stopper which is generally used as a stopper device for containers, provides a convenient sealing means. However, it has problems, for example, (a) the formation of a passage therein is not easy (more so when the thickness of the rubber stopper is large), (b) chips are generated by coring and (c) the reliable formation of a passage of relatively large diameter is very difficult and, accordingly, the rate of solution transfer through the passage has an upper limit.

The operation of connecting a container containing a drug and a container containing a dissolving agent for the drug is widely carried out in medical institutions such as hospitals and the like. This operation is complex and time-consuming and moreover may invite the leakage of the dissolving agent and the contamination of the drug because the operation involves puncturing of the rubber stoppers fitted to the two containers.

In order to avoid such operational complexity and risks of leakage and contamination, there have been made attempts to combine the drug container and the dissolving agent container into one apparatus.

As such an apparatus, Japanese Patent National Publication of Translated Version No. 501129/1986 (International Publication No. WO85/03432) proposes a container for transfusion. This container for transfusion comprises (a) a capsule accommodating a vial as a drug container, (b) a flexible container containing a dissolving agent and having a solution outlet, and (c) a tube connecting the capsule (a) and the flexible container (b). To the tube are fitted a hollow spike needle at the vial side and a breakable member at the flexible container side. The breakable member blocks the passage of the tube and prevents the passing of liquid through the passage.

In actual use of the above container for transfusion, the vial in the capsule is depressed and thereby the rubber stopper of the vial is punctured with the spike needle to connect the vial with the flexible container; then, the breakable member in the tube is manually bent to break it to clear the passage of the tube; thus, the drug and the dissolving agent can be mixed.

The container for transfusion proposed in Japanese Patent National Publication of Translated Version No. 501129/1986 is improved in that the mixing of the drug and the dissolving agent is conducted by connecting the respective containers. However, the container for transfusion has problems in that its operation is still considerably time-consuming because the rubber stopper of the vial must be punctured with the spike needle and then the breakable member is manually bent to clear the passage of the tube and also in that the incomplete bending of the breakable member reduces the flow rate of liquid and requires a longer time for dissolution.

Japanese Patent Application Laid-Open No. 1277/1990 proposes a further improved container for transfusion comprising (1) a flexible container containing a dissolving agent or a diluent and having a liquid passage having an isolator at the upper end, (2) a capsule connected to the flexible container, (3) a drug container sealed with a puncturable stopper at the mouth, held inside the capsule (2), and (4) a communication means for allowing the interiors of the flexible container and the drug container to communicate with each other. The communication means comprises (a) a hollow spike needle having a hub at the middle and each one edge at the two ends and (b) a communication sequence-controlling means to carry out communication in such a sequence that the stopper of the drug container is perforated with one edge of the spike needle and then the isolator of the flexible container is perforated with the other edge.

The container for transfusion proposed in Japanese Patent Application Laid Open No. 1277/1990 is improved in that the mixing of the drug and the dissolving agent is conducted by connecting the drug container and the dissolving agent container and further in that the operation is slightly simplified. In this container for transfusion, however, since a hollow spike needle is used as a communication means for the drug container and the dissolving agent container as in the container for transfusion proposed in Japanese Patent National Publication of Translated Version No. 501129/1986, the edge of the spike needle cuts off part of the stopper fitted to the drug container when the stopper is perforated with the edge, and the resulting debris enter the drug to become foreign matter. That is, in the above container for transfusion, there have arised the generation of foreign matter from coring and the blocking of the through-hole of the tube with part of the debris. The stopper for a drug container, in particular, is thick in order to prevent the quality change of the drug contained in the drug container and therefore tends to invite the generation of debris from coring and the blocking of the through-hole of the spike needle with part of the debris. On the other hand, the use of a hollow spike needle of small inside diameter as a communication means in order to reduce the generation of debris from coring, requires a longer time for mixing of the drug and the dissolving agent.

SUMMARY OF THE INVENTION

The present invention has been made considering the above situation. The first object of the present invention is to provide a stopper for a container which enables easy formation of a passage of large diameter therein without inviting the contamination of container contents with foreign matter generated by the passage formation.

The second object of the present invention is to provide an apparatus comprising a first container containing a first contents such as a drug (of liquid or powder form) or the like and a second container containing a second contents such as a dissolving agent, a diluent (these two are hereinafter referred to as dissolving agent) or the like, in which apparatus the two containers can be connected easily and reliably, the mixing of the drug and the dissolving agent can be conducted in a short time, and the contamination of the mixture with foreign matter is unlikely.

These objects can be achieved by the following stopper device and the following apparatus using the stopper device.

Firstly, the present invention provides a stopper device for a container, enabling, in a state in which the stopper device is fitted to the container, selective access to the interior of the container from outside, which stopper device comprises:

(a) a stopper-support structure having a passage therein, and (b) a selectively removable stopper accommodated in the passage of the stopper-support structure to press the passage wall and block the passage but movable in the passage when depressed, so that insertion of an inflexible hollow tube or nozzle into the passage of the stopper-support structure in a state in which the stopper device is fitted to a container, allows the depression and removal of the stopper in and from the passage and enables air tight access to the interior of the container from outside.

Secondly, the present invention provides an apparatus using the above stopper device.

The first embodiment of the present apparatus is apparatus for separately storing and selectively mixing two components, comprising:

(a) a first container containing a first component and having a stopper defined above fitted thereto;

(b) a compressible, second container containing a second component and having a stopper device defined above fitted thereto;

(c) an inflexible hollow tube capable of selectively accessing the respective interiors of the first and second containers; and (d) a supporting case holding the first container and connected to the stopper device portion of the second container; so that depression of the first container in the supporting case allows the inflexible hollow tube to penetrate the respective stopper devices of the first and second containers and thereby the two containers are allowed to communicate with each other air tightly in order to facilitate proper mixing of the first and second components.

The second embodiment of the present apparatus is apparatus for separately storing and selectively mixing two components, comprising:

(a) a first container containing a first component and having a stopper device defined above fitted thereto;

(b) a compressible, second container containing a second component and having a point of destruction;

(c) an inflexible hollow tube capable of selectively accessing the respective interiors of the first and second containers, said tube having a sharp edge at one end to access the interior of the second container; and (d) a supporting case holding the first container and connected to the point of destruction of the second container; so that depression of the first container in the supporting case allows the inflexible hollow tube to penetrate the stopper device of the first container and perforate the point of destruction of the second container and thereby the two containers are allowed to communicate with each other air tightly in order to facilitate proper mixing of the first and second components.

In the stopper device of the present invention, penetration can be made with a connecting device having no edge and is therefore very easy regardless of the thickness of the stopper device, and misoperation can be avoided such as perforation of port with spike needle as experienced in conventional rubber stoppers. Further with the stopper device of the present invention, air tightness of the container can be reliably maintained until it is used, and the leakage of container contents (e.g. a drug) from the passage of the stopper device can be reliably avoided when a connecting device is fitted to the stopper device.

The stopper device of the present invention enables penetration without giving rise to mechanical destruction. As a result, no foreign matter is generated by the penetration; the passage of stopper device has no restriction in diameter; the connection of two containers, at least one of which has the present stopper device, is reliable and easy; the liquid transfer through the stopper device can be made at a high flow rate; the present stopper device can be used repeatedly.

In the apparatus of the present invention, the stopper device of the first container is penetrated with a connecting device having no edge and therefore no foreign material is generated by the penetration; the inside diameter of the connecting device can be large, whereby the transfer of the dissolving agent in the second container can be made smoothly and also the mixing of the drug in the vial (the first container) and the dissolving agent can be conducted in a very short time.

Such constituent features of the present apparatus is particularly useful when it is used as a container for medical treatment, for example, a container for transfusion which is a combination of a drug vial and a dissolving agent container. Further, when the stopper device of the present invention is used in a container containing a drug solution for injection, the transfer of the solution into an injector can be made by penetrating the stopper device with the front end of the injector from which the needle is removed. Such transfer can avoid the damaging or deformation of the needle during the transfer.

BRIEF DESCRIPTION OF THE DRAWINGS

In FIG. 15, the supporting case is fitted to the communication mouth of the second container (the second communication mouth).

DETAILED DESCRIPTION AND THE PREFERRED EMBODIMENTS

Description is made first on the stopper device for container according to the present invention.

The stopper device of the present invention comprises a stopper support structure having a passage therein and a stopper blocking the passage, and is characterized in that the stopper is accommodated in the passage movably.

Owing to this structural feature, the fitting of a connecting device to the stopper device without cutting the stopper device with the connecting device is possible by simply removing the stopper from the passage of the stopper support structure. As a result, the generation of debris by puncturing of the stopper device and the contamination of container contents with the debris can be avoided. Further, it is easy to fit to the present stopper device even a hollow connecting device of large inside diameter.

Figure 1:
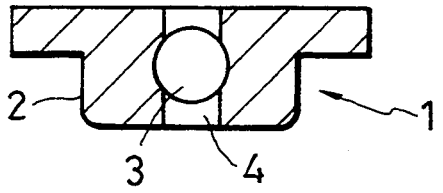
FIG. 1 is a schematic sectional view showing a first example of the stopper device for a container according to the present invention.
Figure 2:
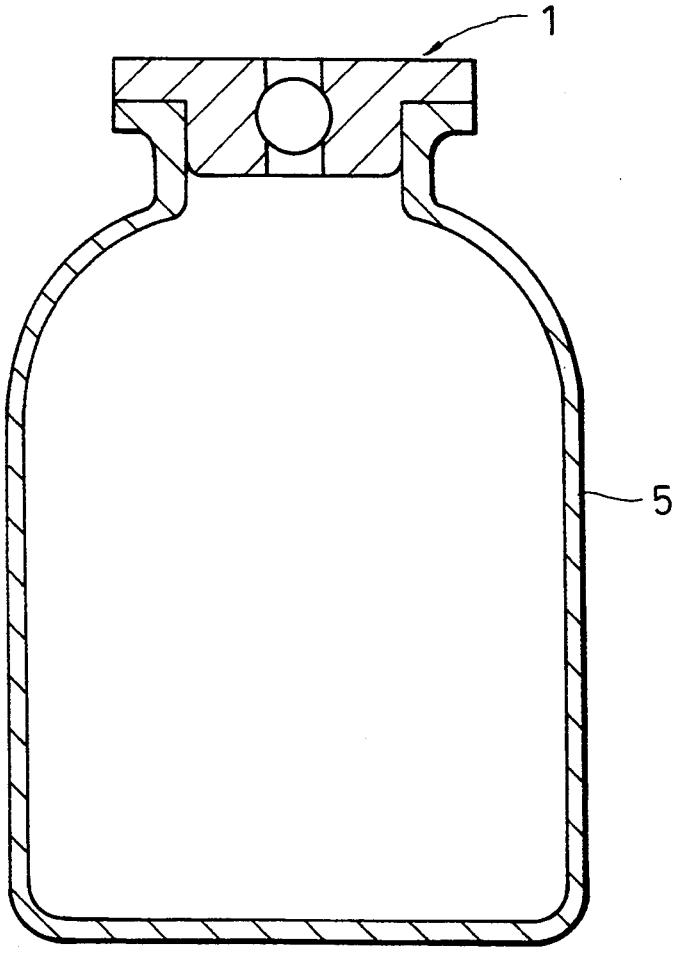
FIG. 2 is a schematic sectional view showing a state in which the present stopper device of FIG. 1 is used in the container.
Figure 3:
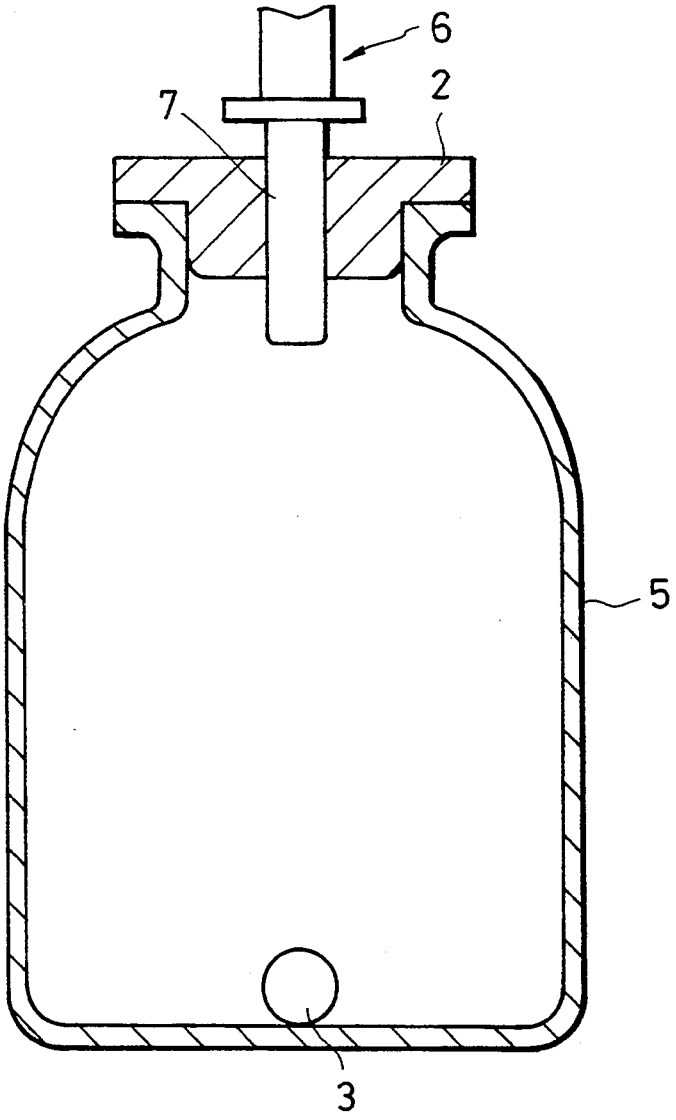
FIG. 3 is a schematic sectional view showing a state in which a connecting device is connected to the present stopper device of FIG. 1.

Then, examples of the stopper device of the present invention are described. FIG. 1 is a schematic sectional view showing a first example of the stopper device for a container according to the present invention. FIG. 2 is a schematic sectional view showing a state in which the present stopper device of FIG. 1 is used in the container. FIG. 3 is a schematic sectional view showing a state in which a connecting device is connected to the present stopper device of FIG. 1 used in the container.

The stopper device 1 shown in FIG. 1 consists of stopper support structure 2 and stopper 3. The stopper 3 is fixed in passage 4 formed in the stopper support structure 2, in a state in which .the stopper 3 presses the passage wall. As a case utilizing the stopper device 1, there can be mentioned its use in vial 5 as a drug container, as shown in FIG. 2. This type of vial is a known glass-made or plastic-made vial, contains inside a solid drug such as a powdery drug, a freeze-dried drug or the like, and can maintain air tightness with a stopper until the vial is used. In general, in order to administer the solid drug in the vial to a patient, it is necessary to dissolve the drug, and the dissolution operation is usually conducted by stabbing the stopper with a spike needle or the like, without removing the stopper to avoid the incoming of foreign matter during dissolution. As a method for introducing a dissolving agent into a vial by using the stopper device of the present invention, a method using connecting device 6 is shown in FIG. 3 (in FIG. 3, dissolving agent is omitted). The insertion portion 7 (inflexible hollow tube or nozzle) of the connecting device 6 is inserted into the passage 4 to remove the stopper 3 from the passage 4. Thus, the insertion of the insertion portion enables access to the interior of the container from outside without allowing the container contents to be exposed to the atmosphere, after which a dissolving agent can be injected into the vial 5 through the connecting device 6 and the solid drug in the vial can be dissolved by the dissolving agent. The insertion portion 7 need not have an edge and there arises no partial cutting-off of the stopper-support structure 2 or the stopper 3.

With the conventional access means, the mechanical destruction of stopper device was inevitable and there were problems such as partial cutting-off of stopper device and large resistance for insertion. In contrast, with the access means of the present invention, access is achieved by simple sliding of the stopper fixed in the passage so as to press the passage wall, and therefore there are substantially no problems such as above.

Incidentally, by making the outside diameter of the insertion portion 7 larger than the minimum inside diameter of the passage, the air tightness at the connected portion can be achieved and the leakage of drug from the passage 4 can be prevented.

In the above example, a solid drug is contained in a container. However, the drug may be not only a solid but also a liquid; in other words, the present stopper device can be used for liquid-liquid mixing as well.

FIGS. 4 to 8 show other examples of the stopper device of the present invention. In the stopper device shown in FIG. 4, the stopper 43 is substantially spherical and the wall of the passage 44 has rib-like projections 45 and 46. By using connecting device 6 whose insertion portion 7 has an outer diameter smaller than the inside diameter of the passage 44 but larger than the inside diameters of the rib-like projections 45 and 46, the insertion resistance which the connecting device 6 receives when inserted into the stopper device is small and the connection of the connecting device 6 to the stopper device is easy. Further, the rib-like projections 45 and 46 can reliably prevent the leakage of drug from passage. Furthermore, the rib-like projections 45 and 46 can prevent the falling-off of the stopper 43 from the passage by natural action, whereby the air tightness inside the container during transportation or storage can be maintained reliably.

Figure 5:
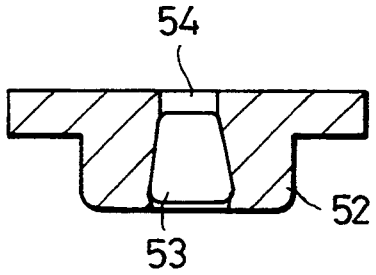
FIG. 5 is a schematic sectional view showing a third example of the stopper device for a container according to the present invention.

The stopper device shown in FIG. 5 uses a stopper 53 of substantially truncated cone shape and has a passage 54 of tapered shape whose diameter is larger at a position nearer the container inside. By using a connecting device 6 whose insertion portion 7 has an outer diameter larger than the minimum inside diameter of the passage 54 but smaller than the maximum inside diameter, the insertion resistance which the connecting device 6 receives when inserted into the stopper device is small and the connection of the connecting device 6 to the stopper device is easy. Further, the use of such a connecting device can reliably prevent the leakage of drug from passage.

Figure 6:
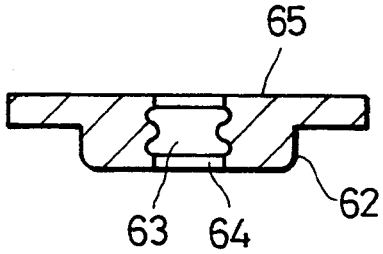
FIG. 6 is a schematic sectional view showing a fourth example of the stopper device for a container according to the present invention.

In the stopper device shown in FIG. 6, a grooved, substantially disc-like stopper 63 is used and rib-like projection 65 is formed in the passage 64. By using the substantially disc-like stopper 63, it is easy to form the passage 64 having an inside diameter larger than the thickness of the stopper device. Further, by forming the rib-like projection 65, it is possible to prevent the falling-off of the stopper 63 from the passage 64 by natural action.

Figure 7:
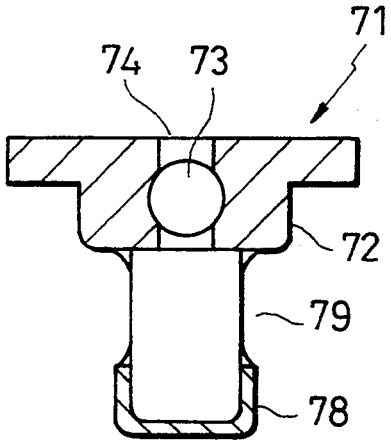
FIG. 7 is a schematic sectional view showing a fifth example of the stopper device for a container according to the present invention.
Figure 8:
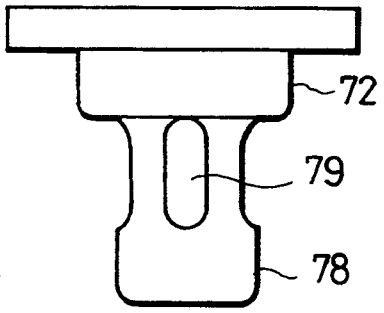
FIG. 8 is a schematic front view showing a fifth example of the stopper device for a container according to the present invention.
Figure 9:
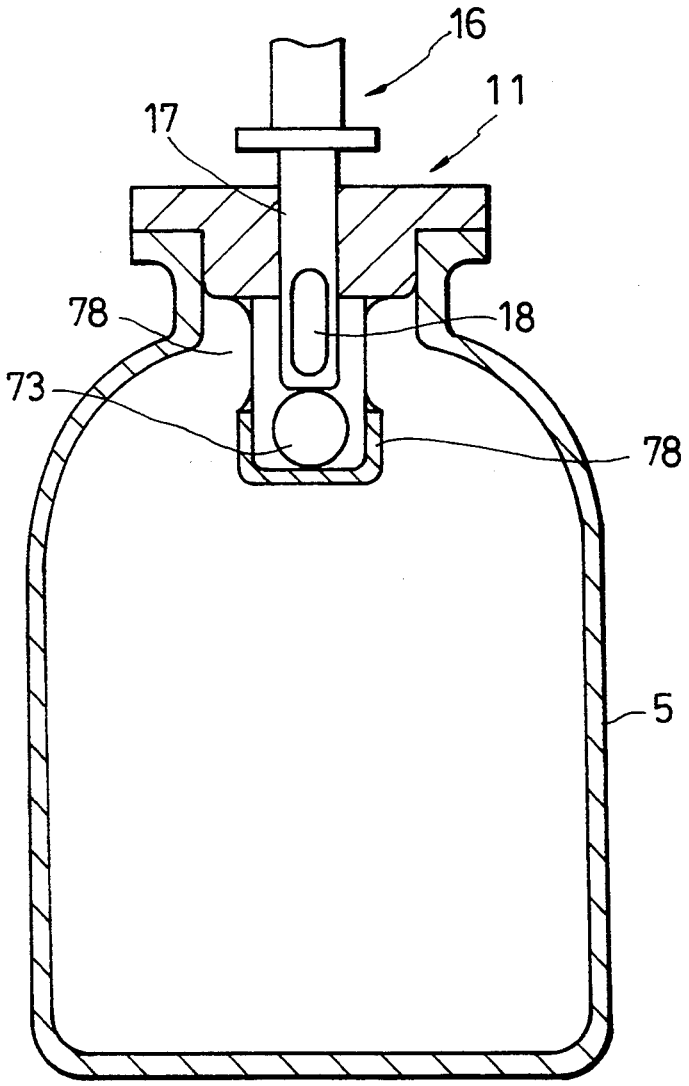
FIG. 9 is a schematic sectional view showing a state in which a connecting device is connected to the present stopper device of FIGS. 7 and 8.

The stopper device 71 shown in FIGS. 7 and 8 is constituted by stopper support structure 72, substantially spherical stopper 73 and stopper receiver 78. The stopper-support structure 72 and the stopper receiver 78 are made in one-piece. The stopper receiver 78 has hole 79. FIG. 7 shows a schematic sectional view of the stopper device 71, and FIG. 8 shows a schematic front view of the stopper device 71. FIG. 9 shows a case in which the stopper device 71 is used in a container. FIG. 9 is a schematic fragmentary sectional view showing a state in which a connecting device 16 is inserted into the stopper device 71. The connecting device 16 has a side hole 18 at the insertion portion 17. When a dissolving agent is introduced into vial 5 through the connecting device 16, the dissolving agent is injected through the side hole 18 and the hole 79. At this time, the stopper 73 is moved from inside the passage 74 to the stopper receiver 78 and trapped in the stopper receiver 78. This can prevent the generation of debris by the collision of the stopper 73 with the vial 5. Further, having the side hole 18 at the front end, the insertion portion 17 is not blocked by the stopper 73.

In the present invention, the materials for the stopper device include the followings. The material for the stopper support structure is preferably an elastomer such as synthetic rubber (e.g. isoprene rubber, butadiene rubber, butyl rubber, styrene-butadiene rubber, chloroprene rubber, silicone rubber, fluorocarbon rubber, ethylene-propylene rubber), natural rubber or the like, in view of the functions required for the stopper device. Such an elastomer is preferably used in the whole portion of the stopper support structure or in the stopper-holding portion of the structure. The material for the stopper can be a synthetic resin (e.g. polypropylene resin, polyethylene resin, styrene resin, acrylic resin, polyamide resin, fluorocarbon rosin), an inorganic material (e.g. glass, ceramic), a metallic material (e.g. aluminum, stainless steel) or the like. The material for the stopper can also be an elastomer as mentioned above. In this case, the material for the stopper-support structure is preferably an elastomer other than used for the stopper. Anyhow, the material for the stopper-support structure and the material for the stopper preferably have different elastic moduli.

That is, since the stopper is, in principle, fixed in the passage so as to press the passage wall, at least either of the material for the passage wall and the material for the stopper is preferably an elastomer. Any of these materials may be an elastomer because it allows the stopper to exhibit its function sufficiently. Only, the elastic modulus of the stopper support structure is preferably larger than the elastic modulus of the stopper in view of the fittability of stopper device to container and the resulting air tightness.

Since the stopper slides in the passage, the stopper is preferably made of a material of low sliding resistance. In view of the fact that the stopper surface undergoes sliding, the material for the stopper can be a relatively hard material to prevent the generation of debris by friction. The stopper made of a hard material can reduce sliding resistance.

Figure 10:
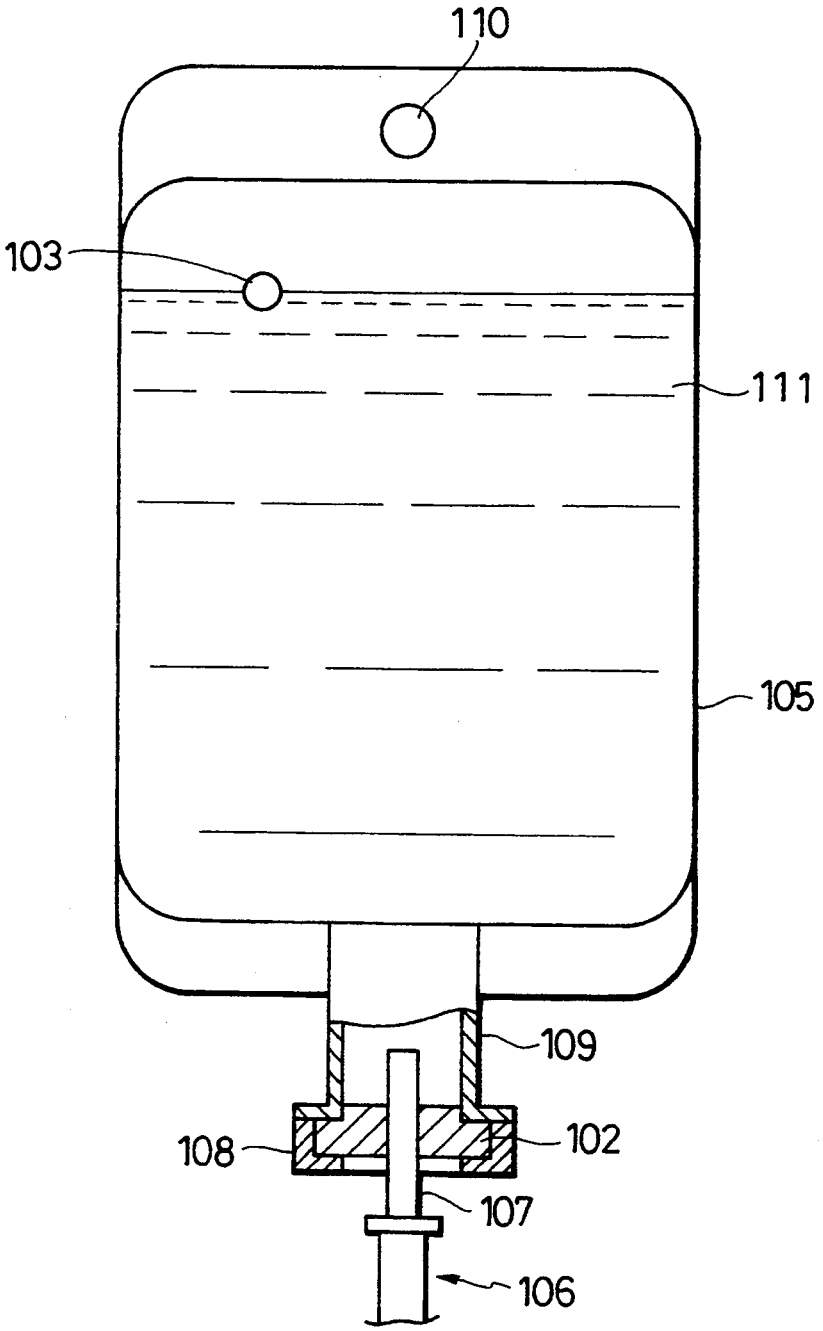
FIG. 10 is a schematic sectional view showing a state in which the present stopper device of FIG. 1 is used in the container for transfusion.

Next is shown, in FIG. 10, a case in which the stopper device of the present invention is used in a container for transfusion. In FIG. 10, solution 111 to be transfused is contained in container 105 for transfusion; stopper support structure 102 is fixed to port 109 with cap 108; the insertion tube 107 of solution administration set 106 as a connecting device is inserted into the stopper support structure 102. In FIG. 10, stopper 103 which is accommodated in the passage of the stopper-support structure 102, is pushed out of the passage with the insertion tube 107 and floats in the solution 111 to be transfused. When the stopper 103 is made of a material having a specific gravity larger than that of the solution 111, the stopper 103 sinks in the solution 111. The container 105 is hung on a hanger by the use of a suspension hole 110 and the solution 111 is administered to a patient through the transfusion device 106. With the present stopper device, the insertion tube 107 can be edgeless, whereby conventional troubles such as perforation of port 109 by misoperation can be avoided.

In the above, various examples of the present stopper device were described. However, various modifications can be applied to them as long as they do not deviate from the gist of the present invention.

Then, description is made on the apparatus of the present invention using the above stopper device.

The apparatus of the present invention is basically constituted by (a) a first container having a first communication mouth to which the present stopper device is fitted, (b) a compressible, second container having a second communication mouth, (c) a supporting case holding the first container and connected to the second container, and (d) a communication device communicating with the first and second communication mouths. The second communication mouth can be equipped with either the present stopper device or a simple isolator.

Owing to the above constitution, the connection of the communication device to the first and second communication mouths without cutting the stopper device with the communication device is possible by simply removing the stopper from the passage of the stopper-support structure. As a result, there can be avoided the contamination of container contents with foreign matter (e.g. the debris generated by puncturing of the stopper device) and the blocking of the through-hole of the communication device with the foreign matter.

Further, the first container and the second container can be easily connected by penetrating the stopper device of the first container and perforating the isolator of the second communication mouth (or penetrating the stopper device of the second container) with the communication device. Since the communication device is hollow and has a through-hole of large diameter, the transfer of liquid therethrough is smooth, making it possible to mix a drug and a dissolving agent in a short time.

Furthermore, since the penetration resistance when the stopper device is penetrated with the communication device, is determined by a state in which the stopper is fitted to the stopper-support structure, the penetration resistance can be controlled easily. As a result, the sequence of penetration operation can be determined as desired; that is, the sequence of the penetration of the stopper device of the first container with the communication device can be earlier or later than the perforation of the isolator of the second container (or the penetration of the stopper device of the second container), or these communication operations can be conducted nearly simultaneously.

Figure 11:
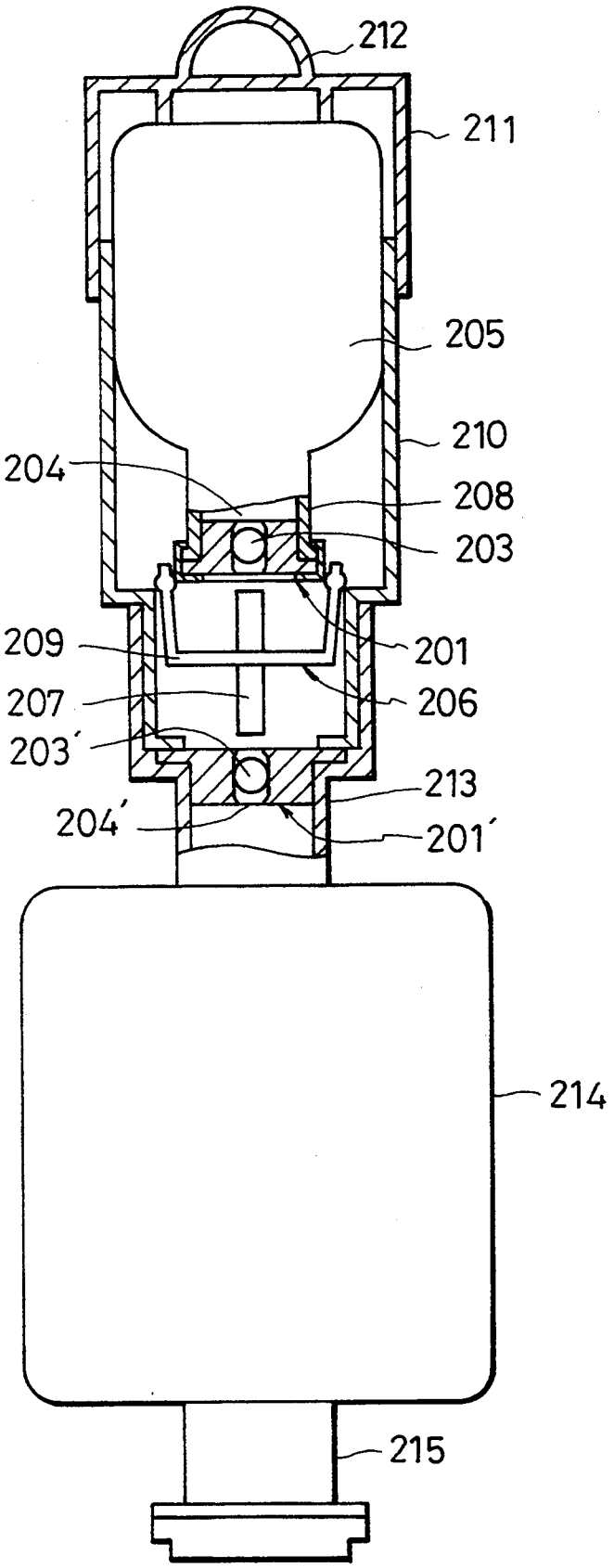
FIG. 11 is a schematic key portion sectional view showing an example of the apparatus of the present invention.
Figure 12:
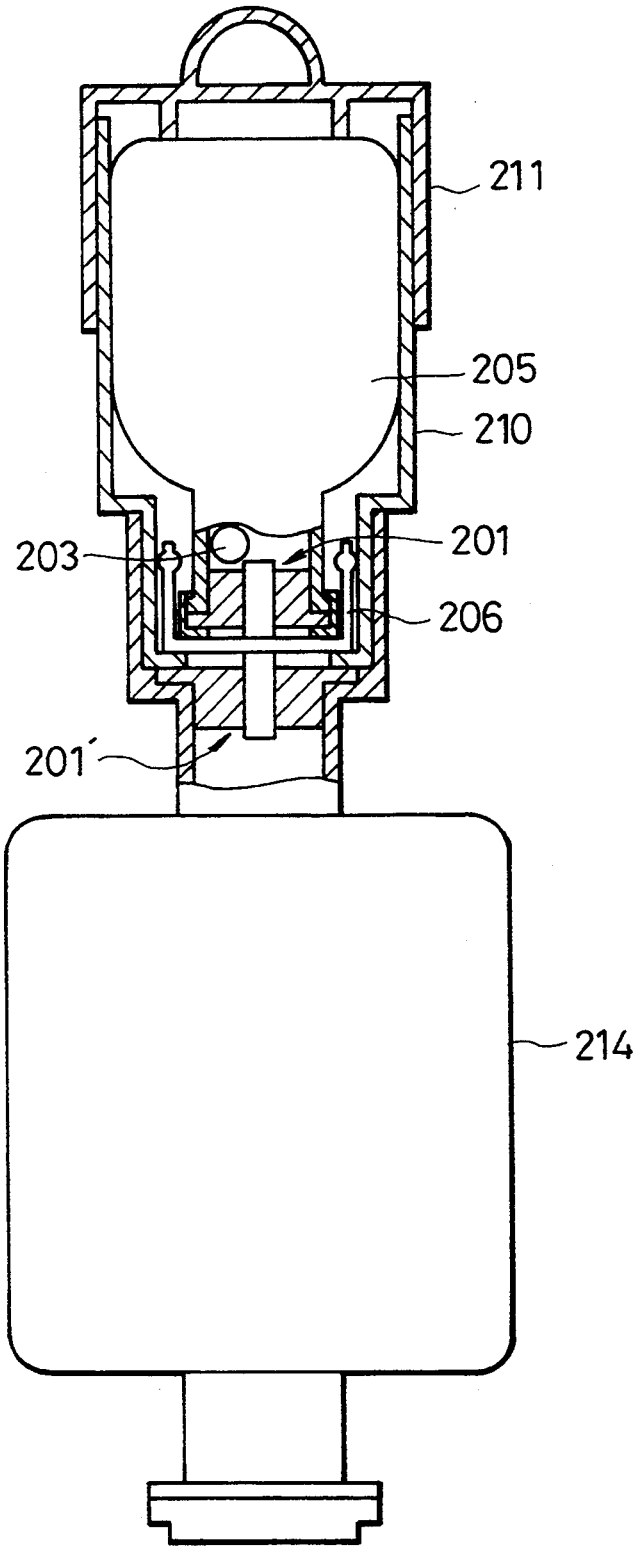
FIG. 12 is a schematic key portion sectional view showing a state in which the two containers of the apparatus of FIG. 11 are in communication with each other by the operation of the communication device of the apparatus.
Figure 13:
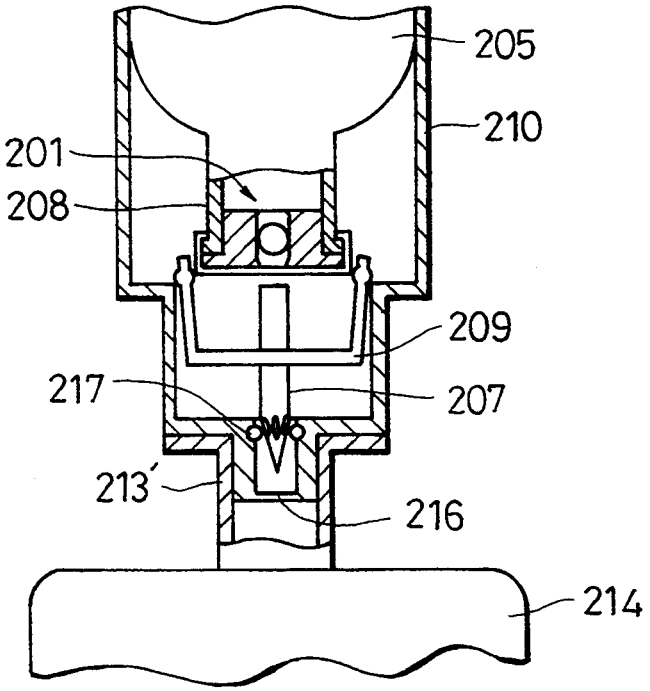
FIG. 13 is a schematic fragmentary sectional view showing another example of the apparatus of the present invention and indicates a different communication device used therein.
Figure 14:
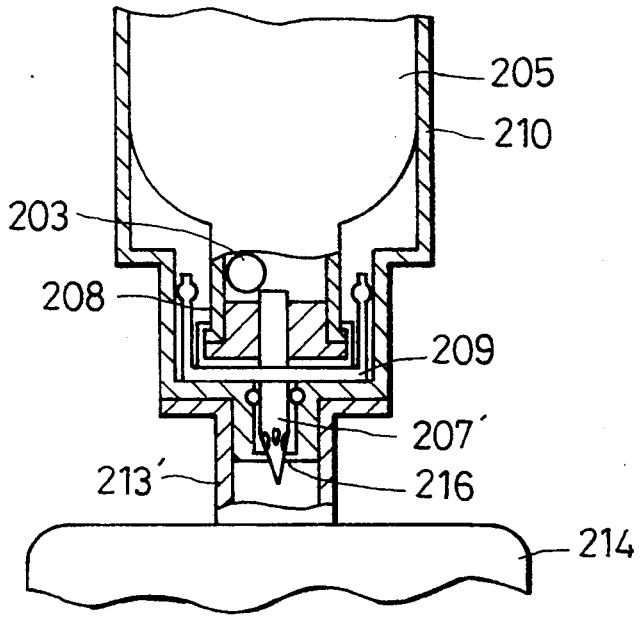
FIG. 14 is a schematic fragmentary sectional view showing a state in which the two containers of the apparatus of FIG. 13 are in communication with each other by the operation of the communication device of the apparatus.

Next, the present apparatus is described on examples. FIG. 11 is a schematic key portion sectional view showing an example of the apparatus of the present invention. FIG. 12 is a schematic key portion sectional view showing a state in which the two containers of the apparatus of FIG. 11 are in communication with each other by the operation of the communication device of the apparatus. FIG. 13 is a schematic fragmentary sectional view showing another example of the apparatus of the present invention and indicates a different communication device used therein. FIG. 14 is a schematic fragmentary sectional view showing a state in which the two containers of the apparatus of FIG. 13 are in communication with each other by the operation of the communication device of the apparatus.

The apparatus shown in FIG. 11 is typically used as a container for transfusion, for example. First container 205 and second container 214 are connectable to each other via communication device 206; the two containers are connected by supporting case 210; the supporting case has cap member 211. The first container 205 is a container for a drug such as a powdery drug, a freeze-dried drug or the like (the drug need not necessarily be a solid) (the first container is also hereinafter referred to as vial). The first container 205 is a known glass-made or plastic-made container, has first communication mouth 208 sealed with stopper device 201, and is accommodated in the supporting case 210 with the first communication mouth 208 directed downward (downward in FIG. 11).

Figure 4:
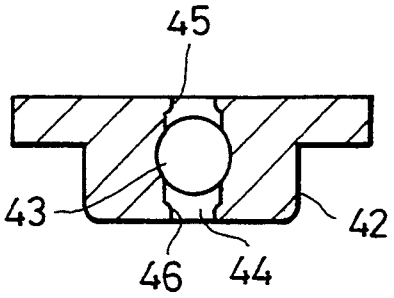
FIG. 4 is a schematic sectional view showing a second example of the stopper device for a container according to the present invention.

The apparatus shown in FIG. 11 uses, as the stopper device 201 of the first communication device 208, a stopper device having the same structure as shown in FIG. 4. A stopper device of other structure may be used.

The second container 214 is a container for a dissolving agent and is made of a highly flexible material such as low-density polyethylene resin, linear low-density polyethylene resin, polypropylene resin, soft polyester resin, chlorinated polyethylene resin, vinyl chloride resin, ethylene-vinyl acetate copolymer or the like. Of these, polyolefin resins such as low-density polyethylene resin, straight-chain low-density polyethylene resin, polypropylene resin and the like are preferable because they have excellent chemical resistance and little leaching matter in dissolving agent and are inexpensive, i.e. economical. The second container 214 has, at the upper end (upper in FIG. 11), a second communication mouth 213 and, at the lower end, a solution outlet 215. The second communication mouth 213 is sealed with a stopper device 201'. In the apparatus of FIG. 11, the stopper device 201' is the same type as the stopper device 201 used for sealing the first communication mouth 208 of the first container 205. However, the stopper device 201' may have other structure.

The supporting case 210 accommodating the first container 205 has an open upper end (upper in FIG. 11) and a lower end connected to the second communication mouth 213. The supporting case 210 connects the first container 205 accommodated therein, with the second container 214. The supporting case 210 can be made of a polyolefin resin, a styrene resin, an acrylic resin, a polycarbonate resin, a polyamide resin or the like. The use of a polypropylene resin or a methylpentene resin, each of which is capable of transmitting ultraviolet rays relatively easily, is preferable because sterilization of the inside of the supporting case 210 can be conducted easily by applying ultraviolet rays from outside the supporting case 210.

Sterilization after connection of the second container 214 and the supporting case 210 accomodating the first container 205 is generally very difficult when it is conducted according to conventional sterilization techniques. The above embodiment of the present apparatus can easily undergo sterilization especially after connection of the supporting case and the second container. When the second container and the supporting case accomodating the first container are sterilized separately, each one has a cap fitted to the openings (i.e. the second communication mouth and the opening of the supporting case at the side to be connected thereto), whereby the interiors of the supporting case and the second communication mouth are kept in a sterile condition after sterilization; however, when the supporting case and the second container are connected, each cap is removed and each opening is exposed to the atmosphere, whereby the interiors of the apparatus may be contaminated with various bacteria and impurities. For this reason, resterilization after connection of the supporting case and the second container becomes necessary, in many cases. The reason that sterilization after connection is generally difficult according to conventional sterilization techniques is as follows. Because a solid is contained in the first container, the presence of moisture must be avoided. Thus, sterilization after the first container is accommodated in the supporting case must be conducted by gas sterilization or the like in which moisture is present. On the other hand, a liquid is contained in the second container and its sterilization is generally conducted by autoclave sterilization in view of the sterilization efficiency. Thus, due to the different sterilization methods adopted for the supporting case and the second container, sterilization by the same method is difficult after connection. In such a case, ultraviolet sterilization can be very conveniently used in the above embodiment of the present apparatus (the sterilizing power of ultraviolet rays is relatively weak but is sufficient in this stage). The upper end of the supporting case 210 is covered with a cover member 211. This cover member 211 not only protects the first container 205 aseptically but also serves to depress the first container 205. It can 'take various structures. The cover member 211 has suspension means 212 on the upper surface, whereby the apparatus of the present invention, when used as a container for transfusion, can be used by hanging on a hanger or the like.

The communication device 206 is constituted by hollow tube 207 and hollow-tube-holding member 209, wherein the hollow tube 207 is fixed to the hollow-tube-holding member 209. The communication device 206 is provided movably between the first communication mouth 208 of the lower end of the supporting case 210 and the second communication mouth 213.

In the present invention, examples of the drug which can be contained in the first container (vial) 205, include cephem type antibiotics such as cefazolin sodium, ceftizoxime sodium and the like; penicillin type antibiotics such as ampicillin sodium, carbenicillin sodium and the like; antitumor drugs such as mitomycin C, fluorouracil and the like; antiulcer drugs such as famotidine, ranitidine hydrochloride and the like; and thrombolytic drugs such as urokinase and the like.

Examples of the dissolving agent which can be contained in the second container 214, include a physiological saline solution, a 5% glucose solution, a distilled water for injection and solutions containing various electrolytes.

FIG. 12 indicates a state in which the first container 205 and the second container 214 are in communication with each other via the communication device 206 by depressing the first container 205 with the cover member 211. By depressing the first container 205 'with the cover member 211, the hollow tube 207 of the communication device 206 is inserted into the passage 204 of the stopper device 201 of the first container 205 and consequently the stopper 203 is pushed out from the passage 204 into the first container 205. By further depressing the first container 205 with the cover member 211, the communication device 206 moves towards the stopper device 201' of the second container 214; the hollow tube 207 of the communication device 206 is inserted into the passage 204' of the stopper device 201' of the second container 214; and the stopper 203' is pushed out from the passage 204' into the second container 214. Thus, The interior of the first container 205 and the interior of the second container 214 are allowed to communicate with each other by the action of the communication device 206. Since the communication device 206 has no edge, troubles can be avoided such as the generation of foreign matter in container insides by perforation and the blocking of the hollow tube 207 of the communication device 206 with the foreign matter. By making large the diameter of the passage 204 (but smaller than the outside diameter of the hollow tube 207), insertion resistance can be made small, whereby the inside diameter of the hollow tube 207 can be made large and the drug in the first container 201 and the dissolving agent in the second container 214 can be mixed in a short time.

Once the first container 201 and the second container 214 have communicated with each other as above, the second container 214 is compressed or rubbed to feed part of the dissolving agent contained therein, into the first container 205 to dissolve the drug contained therein. Then, the second container 214 is compressed or rubbed again, whereby the solution in the first container 201 is returned into the second container 214. The resulting solution in the second container 214 is used as a solution to be transfused, by connecting a transfusion device or the like to the solution outlet 215 of the second container 214.

The sequence of access of the hollow tube 207 to the first container and the second container is important. That is, when the second container contains a liquid and the first container contains a solid, if the hollow tube accesses the second container first and the other end of the hollow tube is open, there may occur the leakage of second container contents through the open other end of the hollow tube. Since the second container is compressible, there is a high possibility for the second container contents to be pushed out through the open other end of the hollow tube during operation.

Hence, when the one end of the hollow tube is in access to the second container, the other end must not be open and must be air tightly held at the entrance of the stopper device fitted to the first communication mouth. In other words, the other end must be in the passage of the first communication mouth. As long as air tightness is maintained, the other end may be maintained in the passage. Otherwise, the other end is allowed to access the first container prior to the access of the hollow tube to the second container, by pushing up the stopper and removing it from the passage. Since the first container contains a solid, the earlier access of the hollow tube to the first container gives no problem as mentioned above. Preferably, however, the other end of the hollow tube is air tightly held in the passage of the first communication mouth; the movement of the hollow tube is stopped at this position; with this condition being maintained, the communication device is lowered downward (towards the second container) so that the one end of the hollow tube is air tightly held in the passage of the second communication mouth.

The control of the above access sequence can be made by adjusting the movement resistances of the hollow-tube-holding member 209 of the communication device 206 and the first communication mouth 208 or the supporting case 210 (the respective movement resistances are referred to as A and B), the insertion resistances of the hollow tube 207 when inserted into the passages 204 and 204' (the respective insertion resistances are referred to as C and C') and the movement resistances of the stopper 203 and 203' (respective movement resistances are referred to as D and D').

Examples of the access sequence are as follows depending upon the relative levels of A, B, C, C', D and D'.

(1) *When $B>A$ and $B>C+D$ (the levels of C' and D' are not cricital)*

The hollow tube is allowed to make complete access first to the first container and then make access to the second container.

(2) *When $B>A$, $C+D>B$ and $C+D>B+C'+D'$*

The hollow tube is first allowed to remain in the passage of the first communication mouth (not access the first container yet); with the condition being maintained, the hollow tube accesses the second container; then, it accesses the first container.

(3) *When $B>A$, $C+D>B$ and $B+C'+D'>C+D$*

The hollow tube is first kept in the passage of the second communication mouth while remaining in the passage of the first communication mouth; then, it accesses the first container, followed by accessing the second container.

Any of (1) to (3) is good from the standpoint of prevention of leakage of second container contents. When the possible leakage of first container contents is also considered, (2) and (3) are good. (3) is good from the standpoints of safety and reliability, i.e. low leakage possibility and low misoperation possibility.

On the other hand, the following case is not desirable.

$$A>B+C'+D'$$

When the stopper device has a structure having a stopper receiver 78 as shown in FIG. 7, there can be prevented the generation, in first container, of debris by collision of stopper with first container in first container, as well as the blocking of hollow tube with stopper.

Next, description is made on other example of the apparatus of the present invention referring to FIGS. 13 and 14. The second communication mouth 213' of second container 214 is sealed with isolator 216 (a point of destruction). The hollow tube 207' of communication device 206 has an edge at one end facing the second container 214. The method for connecting first container 205 and the second container 214 with the communication device 206 is substantially the same as used in the above example of the present apparatus. The first container 205 is lowered; the hollow tube 207' of the communication device is inserted into the passage 204 of the stopper device of the first container; the stopper 203 in the passage 204 is pushed out from the passage 204 into the first container 205. The first container 205 is further lowered; the communication device 206 moves towards the isolator 216 of the second container and the edge of the hollow tube 207' of the communication tube 206 breaks the isolator 216 of the second container; thereby, the interior of the first container 205 and the interior of the second container 214 come in communication with each other by the action of the communication device 206. Since the isolator 216 consists of a plastic-made thin film, the hollow tube 207' receives a small insertion resistance even if its internal diameter is large, unlike the case the hollow tube is inserted into a rubber stopper; as a result, the hollow tube can easily break the isolator 216 and there arises neither generation of debris by perforation nor blocking of hollow tube 207' with the debris. Arrangement of a sealing ring 217 at the entrance of the hollow tube can prevent the leakage of dissolving agent in second container 214, into supporting case which may occur after the hollow tube 214 has perforated the isolator 216.

Examples of the present apparatus were described above. However, the present invention can adopt various modifications as long as they do not deviate from the gist of the present invention.

EXAMPLE 1

The stopper device of the present invention shown in FIG. 1 and a conventional rubber stopper were evaluated for generation of debris from coring. The stopper device consisted of a stopper support structure made of an isoprene rubber, of 27 mm in diameter, 8 mm in thickness and 4 mm in diameter of passage and a spherical stopper made of stainless steel, of 5 mm in diameter. The conventional rubber stopper was made of an isoprene rubber and had a diameter of 27 mm and a thickness of 6 mm. The stopper device and the rubber stopper were subjected to autoclave sterilization, washed with a neutral detergent, rinsed with water, and washed with a water which had been filtered through a filter of 0.2 micron in pore diameter. 100 ml of the same water as used for the above washing was placed in a glass-made vial, and the above-prepared stopper device or rubber stopper was fitted to the vial.

Into the stopper device of the present invention was once inserted a plastic-made connecting device of 5 mm in outside diameter. A plastic-made spike needle of 4 mm in outer diameter was thrusted into the rubber stopper. Then, the water in the vial was filtered through a filter paper with a grid pattern, of 0.45 micron in pore diameter. The resulting filter paper was dried and observed under a microscope at a magnification of 100 to count the number of colored chips present on the filter paper. The case in which no connecting device was inserted into the stopper device or no thrusting was given to the rubber stopper, was used as a control. The number of samples was 5 each for the stopper device and the rubber stopper. The average number of colored chips per sample was 0.2 in the control for the present stopper device, 0.2 in the present stopper device, 0.3 in the control for the rubber stopper and 3.2 in the rubber stopper. Thus, the generation of debris from coring was significantly low in the stopper device of the present invention.

EXAMPLE 2

Each of the same stopper device (of the present invention) and rubber stopper as used in Example 1 was fitted to a glass-made vial. A connecting device of 5 mm in outside diameter was inserted into the stopper device, and a stainless steel (18G)-made injection needle was thrusted into the rubber stopper. Then, the insertion portion of the connecting device and the front end of the injection needle were visually examined. As a result, the insertion portion of the connecting device showed no adhesion of any foreign matter derived from the stopper device; on the other hand, the front end of the injection needle, the inside of the needle, in particular, showed adhesion of chips of the rubber stopper.

EXAMPLE 3

Figure 15:
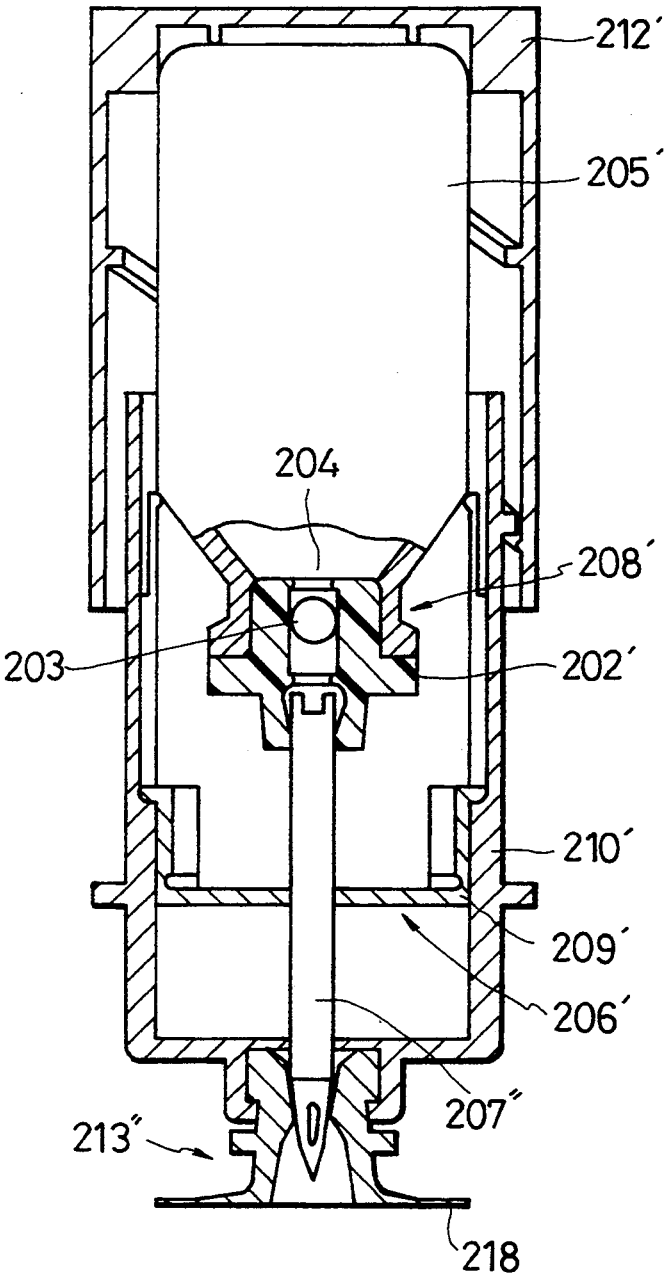
FIG. 15 is a schematic fragmentary sectional view of yet another example of the apparatus of the present invention and indicates the supporting case portion of the apparatus containing the first container.

An apparatus of the present invention as shown in FIG. 15 was constituted. That is, 2 g of cefazolin sodium is placed in a 20-ml glass-made vial 205', and the vial is sealed with a stopper device. The stopper device consists of (a) a stopper support structure having a passage therein (the entrance of the passage has a concave shape so as to fit to the front end of a hollow tube to be inserted into the passage) (stopper support structure: made of a butyl rubber, 13 mm in outside diameter, 16 mm in thickness; passage: 3.5 mm in minimum internal diameter, 4.5 mm in maximum internal diameter), and (b) a spherical stopper made of a polypropylene, of 5.5 mm in diameter, accommodated in the passage of the stopper support structure. The resulting vial is accommodated in a supporting case 210' made of a polypropylene, obtained by injection molding. A cover member 212' is fitted to the supporting case 210'. Inside the supporting case 210' is also accommodated a communication device 206' made of a polypropylene, of 4 mm in outside diameter and 2 mm in inside diameter obtained by injection molding. The hollow tube 207'' of the communication device 206' has an edge at one end, which edge has a side hole at the front end.

The inner surface of the cover member 212' and the outer surface of the supporting case 210' have threads so that the turning of the cover member can depress the vial 205'.

The vial 205' is supported by the pins provided at the inside of the supporting case 210' and the concave-shaped entrance of the stopper device and further is stably held by the cover member 212'.

The one end of the hollow tube 207'' is air tightly fitted to the concave-shaped portion of the stopper device (the entrance of the first communication mouth 208').

Under this condition, the front end of the supporting case 210' is fitted to the second communication mouth 213'' connected to the second container (not shown) for integration, whereby the other end (edge) of the hollow tube 207'' is inserted into the second communication mouth 213'' so as to block it. The second communication mouth 213'' (made of a polypropylene and obtained by injection molding) has a flange 218 and, at this point, is bonded (easily heat-sealed) to the second container. Under this condition, the hollow tube 207'' already has partial connection with the first and second communication devices and, even if either of these communication devices is perforated (or penetrated), can prevent the leakage of container contents, etc.

All the materials used above are sterilized in advance according to known techniques. Specifically, the second container is filled with a dissolving agent, covered with a sterilization cap (not shown) at the second communication mouth 213'', and subjected to autoclave sterilization. Meanwhile, the vial 205' and the communication device 206' are accommodated in the supporting case 210'; the cover member 212' is fitted to the supporting case 210'; the opening of the supporting case 210' at the side to be connected to the second communication mouth 213'' is covered with a sterilization cap (not shown); then, ethylene oxide gas sterilization is effected. Thereafter, while a sterile state is maintained, the sterilization caps are removed and the supporting case 210' accommodating the sterilized vial and the sterilized second container are connected. The insides of the supporting case 210' and the second communication mouth 213'' are substantially aseptic; however, in order to obtain a more aseptic state, it is preferable to conduct ultraviolet sterilization (250–350 nm, 40 W, 20 minutes) because the supporting case 210' and the second communication mouth 213'' can transmit ultraviolet rays.

By allowing the entrance of the stopper device to have a concave shape and holding the hollow tube in a state in which the tube is fitted to the concave-shaped entrance, leakage of liquid, etc. can be prevented even if the timing of stopper removal at the first communication mouth and the timing of isolator breakage are not strictly controlled. In this case, therefore, safe and reliable stopper removal and isolator breakage can be conducted even if no strict operational sequence is adopted. The projection formed at the entrance (for the hollow tube) of the second communication mouth ensures the air tightness between the hollow tube and the second communication mouth.

In the embodiment of FIG. 15, when the supporting case accommodating the vial (the first container) is connected to the second container, the apparatus is already prepared for perforation in a sealed state; therefore, perforation is very reliable and operation is very easy.

Further, since the structure of the second communication mouth is simple, its fitting to the second container is very simple (it can be done by simply heat-sealing the flange to the second container); since the wall of the second container can be allowed to have the function of the isolator (point of destruction) of the second communication mouth, the second communication mouth may be isolator-free and its production becomes very easy. Thus, in the present embodiment, the second container has no particular restriction in structure.

Figure 16:
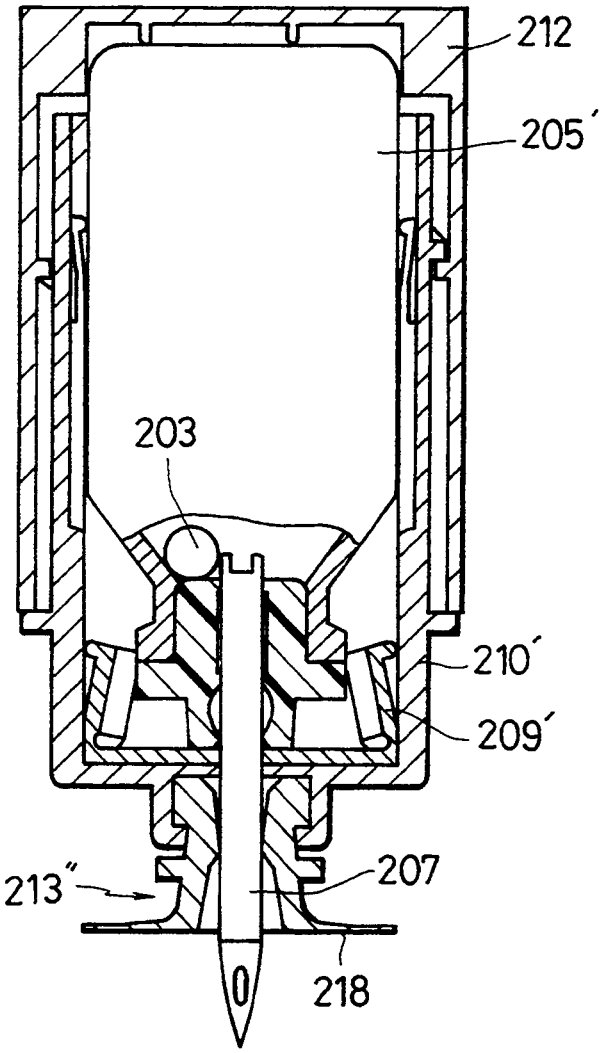
FIG. 16 is a schematic fragmentary sectional view showing a state in which the two containers of the apparatus of FIG. 15 are in communication with each other by the operation of the communication device of the apparatus.
Figure 17:
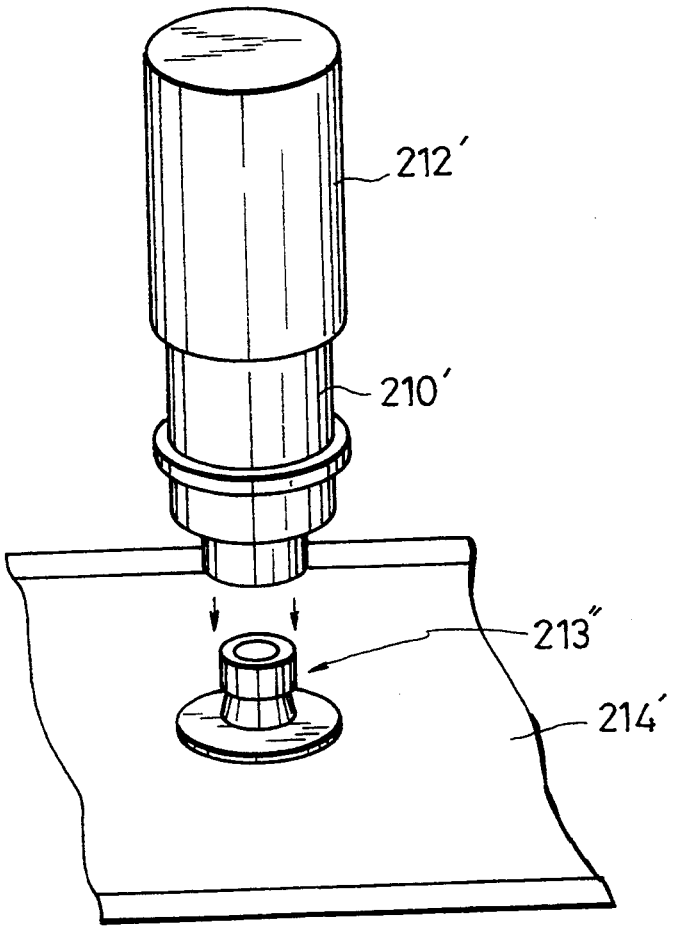
FIGS. 17 and 18 are each a schematic perspective view showing, in the apparatus of FIG. 15, a state in which the supporting case accomodating the first container is going to be fitted to the communication mouth of the second container (only the key portion is shown for the second container).
Figure 18:
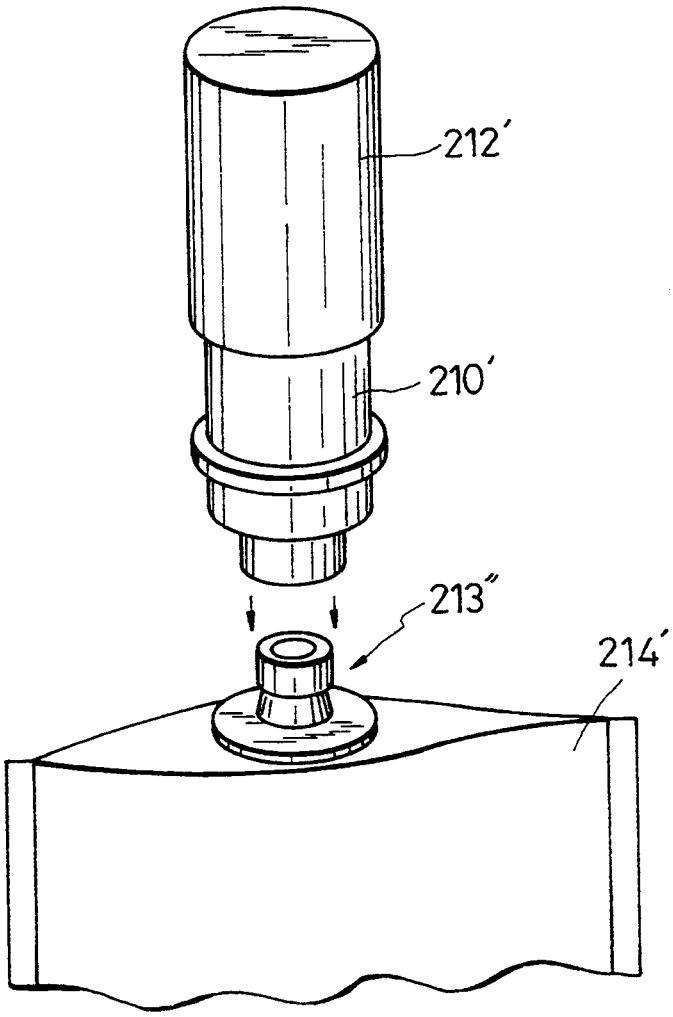

FIGS. 17 and 18 are each a schematic key portion perspective view showing a state in which a supporting case 210' accommodating a vial (a first container) is going to be connected (fitted) to a second communication mouth 213' of a second container 214' or 214''. The second communication mouth can be simply heat-sealed in advance to the side wall (FIG. 17), lower surface, upper surface (FIG. 18), etc. (any desired surface will do as long as it is a flat surface) of the second container. In order to prepare the whole apparatus for shipment, the supporting case accommodating the vial is fitted to the second communication device without communication between the vial and the second container. When the apparatus is in use, only a cover member 212' is turned to a given position to complete the communication between the vial and the second container. Thus, substantially no error takes place in shipment and in communication operation and anybody can carry out the operation without fail. FIG. 16 shows a state in which the communication is complete.

One end of the hollow tube has a sharp edge. The edge is used for insertion into the second container through its thin wall. The insertion resistance is sufficiently small and no debris is generated by the insertion. The insertion sequence is as follows.

(1) By turning the cover member 212', the hollow tube 207'' slides air tightly in the passage 204 of the first communication mouth. As a result, the stopper 203 is pushed up and removed from the passage. The resistance during this process is set so as to be smaller than the resistance which the hollow-tube-holding member 209' shows in the supporting cover 210' (i.e. the deformation strength of the click of the hollow-tube-holding member).

(2) Next, by further turning the cover member, the communication device 206' is depressed and the edge of the hollow tube 207'' is thrusted into the wall of the second container. As a result, the vial and the second container come in mutual contact.

Or, by allowing the stopper 203 to have a large movement resistance, the following sequence is possible. That is, when the hollow tube 207'' comes in contact with the stopper 203, the movement of the communication device 206' is started; the hollow tube 207'' is thrusted into the wall of the second container; then, the hollow tube 207'' pushes up the stopper 203 and removes it. In the present invention, since the stopper device 202' has a concave entrance as mentioned above, the following sequence is also possible. That is, first the communication device 206' is depressed to thrust the hollow tube 207'' into the second container; then, the hollow tube 207'' is allowed to access the vial. Thus, in the present embodiment, the insertion sequence has a large freedom making it possible to simplify the structure of apparatus. Incidentally, the end of the hollow tube facing the vial has a concave cut to prevent the blocking of the hollow tube with the stopper 203.

Although the invention has been described with preferred embodiments, it is to be understood that variations and modifications may be resorted to as will be apparent to those skilled in the art. Such variations and modifications are to be considered within the purview and the scope of the claims appended hereto.

What is claimed is:

1. Apparatus for separately storing and selectively mixing two components, comprising:

(a) a first container containing a first substance in the interior thereof and having a stopper device fitted thereto in an opening therein;

(b) a compressible second container containing a second substance and having a stopper device fitted thereto in an opening therein;

(c) the stopper device of the first and second containers comprising:

(i) a stopper support structure received through an opening in the second container and having a passage therethrough, the passage defining a selected diameter through a stopper-holding portion of the stopper support structure, and (ii) a removable stopper received in the passage of the stopper support structure, the removable stopper having a diameter selected to provide sealing engagement with the passage wall for blocking the passage;

(d) an inflexible hollow tube for selectively accessing the respective interiors of the first and second containers; and (e) a supporting case holding the first container and connected to the stopper device of the second container;

whereby depression of the first container in the supporting case causes the inflexible hollow tube to penetrate the passages of the respective stopper devices of the first and second containers at a penetration point and to push the removable stoppers out of the passages and into the containers so that the containers communicate with each other in an airtight relationship through the inflexible hollow tube in order to facilitate proper mixing of the first and second substances.

2. Apparatus for separately storing and selectively mixing two components, comprising:

(a) a first container containing a first substance and having a stopper device fitted thereto, the stopper device comprising:

(i) a stopper support structure received through an opening in the container and having a passage therethrough, the passage defining a passage wall of a selected diameter through a stopper-holding portion of the stopper support structure, and (ii) a removable stopper in the passage of the stopper support structure, the removable stopper having a diameter selected to provide sealing engagement with the passage wall for blocking the passage;

(b) a compressible second container containing a second substance, the second container having a predetermined penetration point;

(c) an inflexible hollow double-ended tube for accessing the respective interiors of the first and second containers, said tube being separate from the stopper device of the first container and being placed between the stopper device of the first container and the predetermined penetration point of the second container, one end of the tube having a sharp edge for penetrating the predetermined penetration point; and (d) a supporting case accommodating the first container therein and connected to the second container at the penetration point, whereby upon depression of the first container in the supporting case one end of the inflexible hollow double-ended tube penetrates through the passage of the stopper device of the first container, and the other end of the inflexible hollow double-ended tube perforates the penetration point of the second container so that the containers communicate with one another in airtight relationship to facilitate proper mixing of the first and second substances 3. The apparatus according to claim 1, wherein the supporting case has an interior and a cover member and accommodates the first container in the interior thereof, whereby the depression of the first container in the supporting case is effected by depressing the cover member.

4. The apparatus according to claim 1, wherein the supporting case transmits ultraviolet rays so that the first container can be subjected to ultraviolet sterilization in a state in which the first container is held in the supporting case.

5. The apparatus according to claim 1, wherein the supporting case is fittable to the penetration point of the second container in a state in which the supporting case holds the first container inside.

6. The apparatus according to claim 1, wherein the first container is a container used for transfusion.

7. The apparatus according to claim 1, wherein the first container is a drug vial.

8. The apparatus according to claim 1, wherein the second container contains a material selected from the group consisting of dissolving agents and diluents and wherein the second container has a solution outlet.

9. The apparatus according to claim 2, wherein the supporting case has an interior and a cover member and accommodates the first container in the interior thereof, whereby the depression of the first container in the supporting case is effected by depressing the cover member.

10. The apparatus according to claim 2, wherein the supporting case transmits ultraviolet rays so that the first container can be subjected to ultraviolet sterilization in a state in which the first container is held in the supporting case.

11. The apparatus according to claim 2 wherein the supporting case is fittable to the penetration point of the second container in a state in which the supporting case holds the first container inside.

12. The apparatus according to claim 2, wherein the first container is a container used for transfusion.

13. The apparatus according to claim 2, wherein the first container is a drug vial.

14. The apparatus according to claim 2, wherein the second container contains a material selected from the group of materials consisting of dissolving agents and diluents wherein the second container has a solution outlet.

* * * * *